US009339711B2

(12) United States Patent
Goodman

(10) Patent No.: US 9,339,711 B2
(45) **Date of Patent: *May 17, 2016**

(54) REBOUND DEVICE

(71) Applicant: TAMIR GOODMAN SPORTS CONSULTANT, LLC, University Heights, OH (US)

(72) Inventor: Tamir Goodman, University Heights, OH (US)

(73) Assignee: TAMIR GOODMAN SPORTS CONSULTANT, LLC, University Heights, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/245,030

(22) Filed: Apr. 4, 2014

(65) Prior Publication Data

US 2014/0221130 A1 Aug. 7, 2014

Related U.S. Application Data

(63) Continuation of application No. 13/552,134, filed on Jul. 18, 2012, now Pat. No. 8,758,173.

(60) Provisional application No. 61/509,400, filed on Jul. 19, 2011.

(51) Int. Cl.

| | |
|---|---|
| ***A63B 69/00*** | (2006.01) |
| *A63B 5/11* | (2006.01) |
| *A63B 71/06* | (2006.01) |
| *A63B 71/00* | (2006.01) |

(52) U.S. Cl.

CPC ..... *A63B 69/0097* (2013.01); *A63B 69/0071* (2013.01); *A63B 5/11* (2013.01); *A63B 69/0053* (2013.01); *A63B 71/0619* (2013.01); *A63B 2071/0018* (2013.01); *A63B 2207/02* (2013.01); *A63B 2208/00* (2013.01); *A63B 2209/10* (2013.01); *A63B 2210/50* (2013.01); *A63B 2225/09* (2013.01); *A63B 2225/093* (2013.01)

(58) Field of Classification Search

CPC . A63B 5/11; A63B 69/0097; A63B 2063/001
USPC ..... 273/395, 396; 473/434, 435, 447; 482/27–29

See application file for complete search history.

(56) References Cited

U.S. PATENT DOCUMENTS

| | | | |
|---|---|---|---|
| 3,256,021 | A | 6/1966 | Nissen et al. |
| 3,502,330 | A | 3/1970 | Cheftel |
| 4,239,235 | A | 12/1980 | Torres |
| 4,478,420 | A | 10/1984 | Sowards |
| 4,693,472 | A | 9/1987 | Newman et al. |
| 4,703,931 | A | 11/1987 | Steen |
| 5,549,304 | A | 8/1996 | Davis |
| 5,558,338 | A | 9/1996 | Taub |
| 5,613,922 | A | 3/1997 | Hsiang |

(Continued)

*Primary Examiner* — Mark Graham

(74) *Attorney, Agent, or Firm* — Tucker Ellis LLP; Carlos Garritano

(57) ABSTRACT

The subject innovation includes a rebound device which is capable of receiving a ball or any object projected by a user in a substantially downward direction and projecting the same ball or object back to the user in a substantially upward direction in order to allow the user to catch through the use of a rebound surface or net. The rebound surface or net is positioned and angled to receive balls or objects projected downwards from any side of the user and to return or propel those projected balls or objects back to the user.

20 Claims, 10 Drawing Sheets

(56) References Cited

U.S. PATENT DOCUMENTS

| | | | | |
|---|---|---|---|---|
| 5,833,234 | A | 11/1998 | Vavala et al. | |
| 5,934,679 | A | 8/1999 | Strain et al. | |
| 5,938,546 | A | 8/1999 | Caruso | |
| 5,941,798 | A * | 8/1999 | Coan et al. | 482/27 |
| 5,967,911 | A | 10/1999 | McAvoy | |
| 6,209,877 | B1 | 4/2001 | Warnick | |
| 6,357,750 | B1 | 3/2002 | Lievens | |
| D462,733 | S | 9/2002 | Smith, IV | |
| 6,739,988 | B2 | 5/2004 | Jensen et al. | |
| D496,422 | S | 9/2004 | Rota | |
| 7,311,618 | B1 | 12/2007 | Reed et al. | |
| D585,949 | S | 2/2009 | Gaudin et al. | |
| 7,691,032 | B2 * | 4/2010 | Burnham et al. | 482/29 |
| D633,162 | S | 2/2011 | Campanaro et al. | |
| 8,177,651 | B2 | 5/2012 | Curry | |
| 8,758,173 | B2 * | 6/2014 | Goodman | 473/435 |
| 2003/0060309 | A1 | 3/2003 | Smith | |
| 2008/0096695 | A1 | 4/2008 | Winningham et al. | |
| 2010/0120557 | A1 | 5/2010 | Klein et al. | |
| 2011/0059816 | A1 | 3/2011 | Campanaro et al. | |

* cited by examiner

REBOUND DEVICE

CROSS-REFERENCE TO RELATED APPLICATIONS

This application is a continuation of U.S. patent application Ser. No. 13/552,134 filed Jul. 18, 2012, and entitled "REBOUND DEVICE" which claims the benefit of U.S. Provisional Application Ser. No. 61/509,400 filed Jul. 19, 2011, and entitled "REBOUND DEVICE." The entireties of the aforementioned applications are incorporated herein by reference.

BACKGROUND

Passing and catching a ball is an activity that is performed by people of all ages for amusement or enjoyment. Many different sports require that this simple yet basic skill be mastered before participants can effectively compete against each other. Typically, a group of people or athletes will get together and form a practice session or pick-up game to hone their skills in the particular sport or activity they are participating in. Many times, however, it may be difficult to find a partner to practice passing or catching a ball.

As such, a number of devices have been developed to allow an individual or athlete to practice passing, throwing, pitching, kicking, hitting and catching a ball by one's self. Some of these devices provide a vertical surface where the individual or athlete can throw or pass a ball at. The vertical rebound surface typically functions as a backstop and, in some cases, is capable of returning the ball at least a portion of the distance back to the user. In other cases, the elastic nature of the ball may contribute or allow the ball to be returned at least a portion of the distance back to the individual.

These devices are designed to accommodate a somewhat horizontal movement of the ball through the air and rarely return the ball back to the user with enough force to allow the users to practice their catching and reaction skills related to the specific sport or activity at hand.

SUMMARY

The following presents a simplified summary of the innovation in order to provide a basic understanding of some aspects described herein. This summary is not an extensive overview of the claimed subject matter. It is intended to neither identify key or critical elements of the claimed subject matter nor delineate the scope of the subject innovation. Its sole purpose is to present some concepts of the claimed subject matter in a simplified form as a prelude to the more detailed description that is presented later.

The subject innovation includes a rebound device (also referred to as a device) which is capable of receiving a ball projected downwards by a user and projecting the ball back to the user to catch comprising a rebound surface positioned and angled to receive downward projections of the ball from any side of the user. The rebound device can surround a user in order to allow the ball to be projected upwards from a ground-level plane back to the user from various positions and/or angles. The rebound device can further be oriented on a ground-level such that the ball is to be received from a vertical position and returned in a substantially vertical direction.

Also provided is a method of using a rebound device which is capable of receiving a ball projected downwards by a user and projecting the same ball back to the user to catch comprising projecting (e.g., downward projection) a ball towards the rebound device and catching the ball as it rebounds off (e.g., upward projection in a substantially vertical direction) the rebound device and is projected back towards the user, wherein the rebound device is positioned and angled to receive downward projections of the ball from any side of the user.

Also provided is a method of making a rebound device which is capable of receiving a ball projected downwards by a user and projecting the same ball back to the user to catch comprising positioning and angling a rebound surface to receive downward projections of the ball from the user. The rebound device can be a semi-circle design that wraps around a user, wherein the user is standing in a center of the rebound device. Additionally, the rebound device can be surround the user completely offering 360 degrees of frame and rebound surface. Also provided is a kit for a rebound device comprising a rebound surface and a ball, wherein the rebound surface is positioned and angled to receive downward projections of the ball from a user.

The following description and the annexed drawings set forth in detail certain illustrative aspects of the claimed subject matter. These aspects are indicative, however, of but a few of the various ways in which the principles of the innovation may be employed and the claimed subject matter is intended to include all such aspects and their equivalents. Other advantages and novel features of the claimed subject matter will become apparent from the following detailed description of the innovation when considered in conjunction with the drawings.

DETAILED DESCRIPTION

Figure 1:
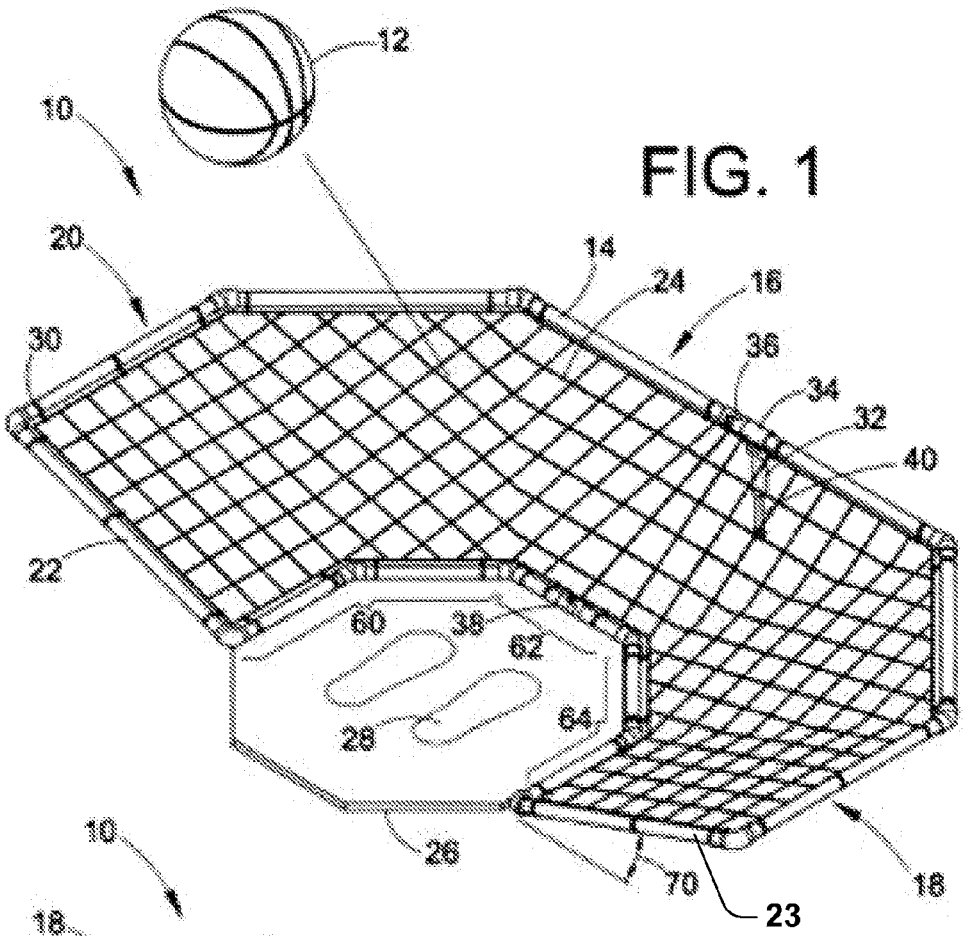
FIG. 1 is a perspective view of an illustrative embodiment of the rebound device.

The subject innovation includes a rebound device which is capable of receiving a ball or any object projected by a user in a substantially downward direction and projecting the same ball or object back to the user in a substantially upward direction in order to allow the user to catch through the use of a rebound surface or net. The rebound surface or net is positioned and angled to receive balls or objects projected downwards from any side of the user and to return or propel those projected balls or objects back to the user.

The rebound device which is capable of receiving a ball or other object from a user and projecting the same ball or other object back to the user is provided. In certain sports or activities, such as basketball, the individual or athlete may need to practice passing or throwing and catching bounce passes. A bounce pass is an indirect pass to an individual that is thrown downwards, toward the ground in the direction of the individual. Thus, a bounce pass is indirect in that it must hit the ground before it reaches the individual. The elastic nature of the ball as it interacts with the hard surface of the ground causes the ball to bounce up from the ground before it reaches the individual. Given the different dynamics involved with these types of passes compared to throwing or passing a ball directly through the air, there is a need in the art for a device which can accommodate bounce passes thrown by an individual or athlete and return such passes back to the individual or athlete with sufficient force to allow the individual or athlete to perfect his or her catching skills.

Furthermore, in sports like basketball, where timing and quickness in movement and decision making is key, what an individual decides to do after catching a pass can also be very important. For example, a basketball player may decide to shoot the ball, dribble the ball or make another pass. Thus, there is also a need in the art for a device which can allow the individual or athlete to practice making such decisions as quickly as possible. Although basketball players are provided as an example of a group of individuals who may benefit from use of such a device, it should be understood that such a device may be used for any number of different sports and/or activities.

The claimed subject matter is described with reference to the drawings, wherein like reference numerals are used to refer to like elements throughout. In the following description, for purposes of explanation, numerous specific details are set forth in order to provide a thorough understanding of the subject innovation. It may be evident, however, that the claimed subject matter may be practiced without these specific details. In other instances, well-known structures and devices are shown in block diagram form in order to facilitate describing the subject innovation.

Features that are described and/or illustrated with respect to one embodiment may be used in the same way or in a similar way in one or more other embodiments and/or in combination with or instead of the features of the other embodiments. These and further aspects and features will be apparent with reference to the following description and attached drawings. In the description and drawings, particular embodiments of the subject innovation have been disclosed in detail as being indicative of some of the ways in which the principles of the subject innovation may be employed, but it is understood that the subject innovation is not limited correspondingly in scope. Rather, the subject innovation includes all changes, modifications and equivalents coming within the scope of the claims appended hereto. The accompanying illustrations are examples of the subject disclosure, but the innovation can appear in various embodiments depending on varying sleeve lengths and personal customizations that are not illustrated here.

Of course, those skilled in the art will recognize many modifications may be made to this configuration without departing from the scope or spirit of the claimed subject matter. Moreover, the word "exemplary" is used herein to mean serving as an example, instance, or illustration. Any aspect or design described herein as "exemplary" is not necessarily to be construed as preferred or advantageous over other aspects or designs. It should be emphasized that the term "comprises/comprising" when used in this specification is taken to specify the presence of stated features, integers, steps or components but does not preclude the presence or addition of one or more other features, integers, steps, components or groups thereof.

Figure 2:
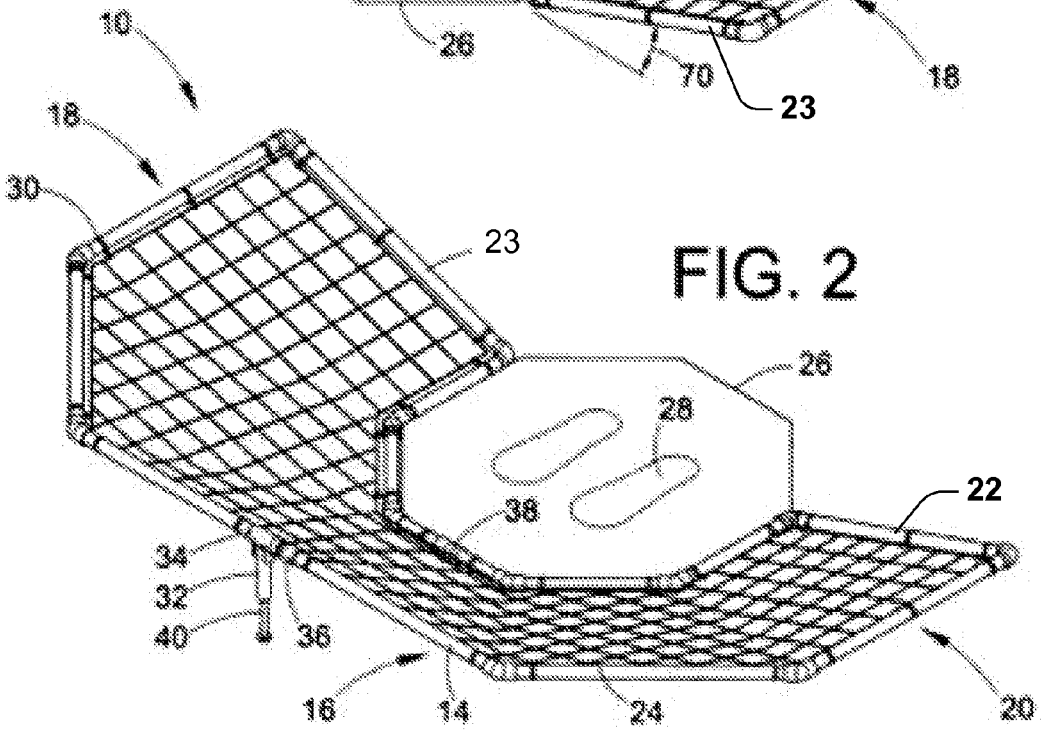
FIG. 2 is a perspective view of an illustrative embodiment of the rebound device.

FIGS. 1 through 9 depict different viewpoints of an illustrative embodiment of a rebound device 10. FIG. 1 and FIG. 2 depict opposing perspective viewpoints of the illustrative embodiment. A ball 12 is shown as it interacts with a rebound surface or net 24. The rebound surface or net 24 (herein referred to as net 24) is connected to a frame 14 of the rebound device 10 through a fastening means 30 such as a hook, illustrated in FIG. 8. The frame 14 can include an outer portion (e.g., portion of the frame 14 furthest from the user positioned on a base 26) and an inner portion (e.g., portion of the frame 14 closest to the user positioned on the base 26). The rebound device 10 includes a front side portion 16, a right side portion 18, and a left side portion 20. The outer portion of the frame 14 can be connected to the inner portion of the frame by a back side portion 22 of the left side portion 20 and a back side portion 23 of the right side portion 18. The rebound device 10 includes the base 26 and a placement pad 28 used to designate an area where the user can position his or her body and/or feet when using the device 10. The rebound device 10 can include a leg 32 to position the frame 14 and net 24 at an angle above the ground (e.g., ground-level, surface to which the user stands, among others). The leg 32 is attached to a hinge 34 which allows the leg 32 to function as a kickstand for example. The leg 32 can be rotated about the frame 14. For instance, the leg can fold up to allow the rebound device 10 to lay flat on the ground or can be folded down to allow the rebound device 10 to sit upright. The leg 32 also includes an extendable member 40 which is capable of adjusting a height of the rebound device 10 above the ground. In addition, the rebound device 10 includes a hinge 36 on its front side portion 16 and a hinge 38 on its back side portion which allow the right side portion 18 and the left side portion 20 of the rebound device 10 to be folded together. It is to be appreciated that the rebound device 10 can include one or more hinges (similar to hinges 36 and 38) in a number of locations on the frame 14 in order to provide folding of the rebound device 10 in various configurations or shapes. (See, for instance, FIG. 6 and FIG. 13).

FIG. 1 also depicts a plurality of tubular elements comprising the support members or frame 14 of the device 10. The support members or frame 14 may be shaped in a polygonal fashion as shown by a first element 60 (that comprises a first and second side of an semi-octagon), a second element 62 (that comprises a third side of an semi-octagon), and a third element 64 (that comprises a fourth and fifth side of an semi-octagon). An angle 70 depicts one of a plurality of angles created by the rebound surface or net 24 extending upwardly and outwardly in a plurality of planes to create a plurality of rebound regions, wherein each plane can include a respective angle 70 from the ground level. The base 26 is also shown to correspond in shape (e.g., at least a front side of the base 26) to the support members or frame 60, 62, 64. It is to be appreciated that the base 26 can be connected to the support members or portion of frame 14 in proximity thereof. In another example, the portion of the frame 14 in proximity to the base 26 (e.g., an inner portion of the frame 14 that is closest to the base 26) can be secured to the ground using, for instance, a stake, a peg, a nail, a spike, an anchor, a rope, and among others.

In certain embodiments, the rebound device 10 comprises the base 26 for the user to position one's self on for use of the device 10. The base can comprise an area to position one's feet thereon, also known as the placement pad 28. In certain embodiments, this area may comprise two depressions in the shape of two feet to ensure that the user maintains a proper athletic stance as he or she uses the rebound device 10. The base 26 can be designed for use by individuals who are left-handed or right-handed. For example, in certain embodiments, opposite sides of the placement pad 28 on the base 26 can designate proper foot placement for left-handed and right-handed individuals respectfully (e.g., right foot more forward for a right-handed user, a left foot more forward for a left-handed user, among others). The placement pad 28 can have a different orientation for a user's feet based on a sport or a drill for such sport that is to be practiced. The base 26 can also comprise a means to adjust the height of the base 26 relative to the ground level. For example, a spacer, a thickness of the base 26, a pad, a foot/leg, among others can be utilized to raise the height of the base 26 (and, in turn, the placement pad 28) in relation to the ground level.

In other embodiments, the shape of the device 10 can be square, rectangular, polygonal, octagonal, semicircular, cage-like, circular, semi-circular, or a combination thereof. The device 10 or frame 14 can be a shape in which a user is centered about the device 10, wherein the shape or frame 14 covers a portion of an angle of a circle that surrounds user. For instance, an outer portion of the frame 14 can be a first shape (e.g., semi-circle, semi-octagon, octagon, circle, among others) and an inner portion of the frame 14 can be a second shape (e.g., semi-circle, semi-octagon, octagon, circle, among others). In one embodiment, the inner portion of the frame 14 (e.g., portion of frame 14 that is closest to the user) is the same shape as the outer portion of the frame 14. In certain embodiments, the shape of the support members or frame 14 may be square, rectangular, polygonal, octagonal, semicircular, cage-like, or circular. In other embodiments, the shape of the rebound surface or net 24 can be square, rectangular, polygonal, octagonal, semicircular, cage-like, or circular. In certain embodiments, the shape of the platform or base 26 can be square, rectangular, polygonal, octagonal, semicircular, cage-like, or circular.

Figure 3:
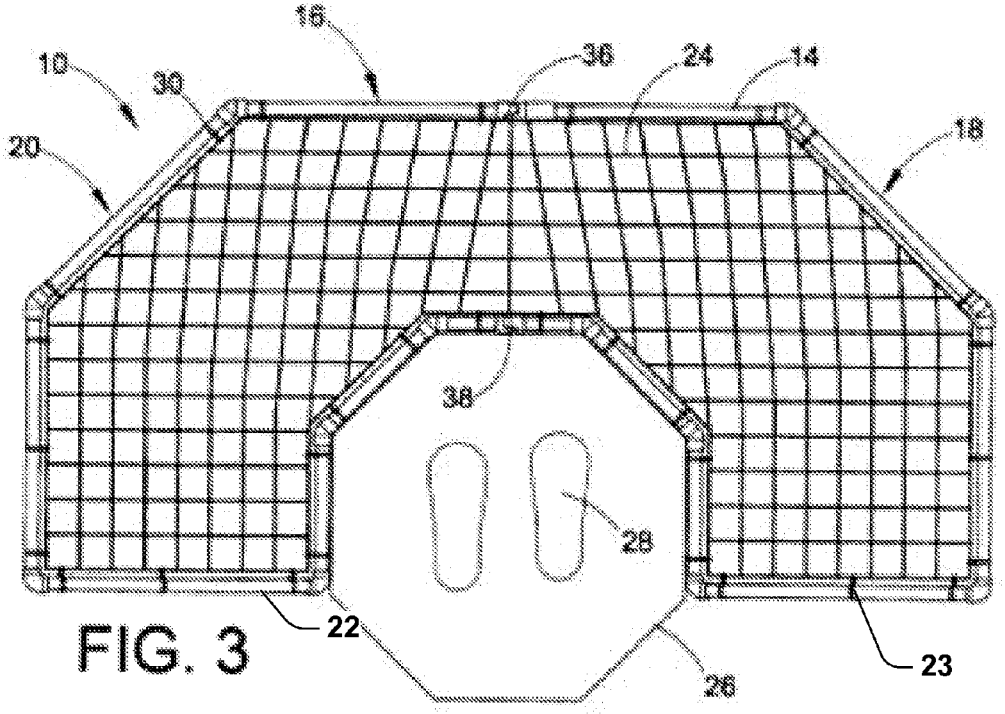
FIG. 3 is an overhead view of an illustrative embodiment of the rebound device.
Figure 4:
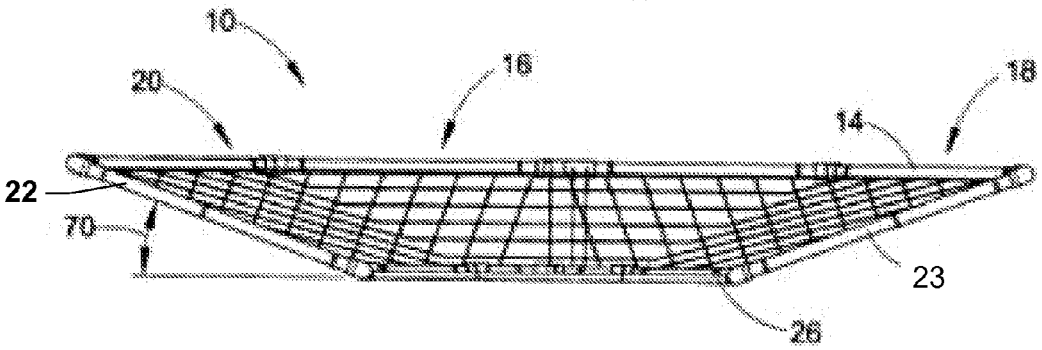
FIG. 4 is a ground level back side view of an illustrative embodiment of the rebound device.
Figure 5:
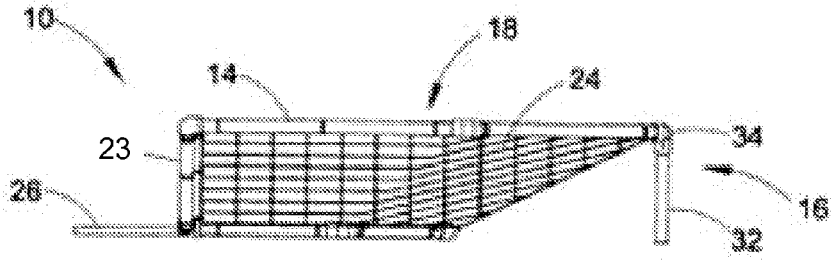
FIG. 5 is a ground level side view of an illustrative embodiment of the rebound device.

FIG. 3 is an overhead view of the rebound device 10. The rebound device 10 can include the FIG. 4 is a back side view of the rebound device 10. FIG. 5 is a side view of the rebound device 10. The rebound device 10 can include the rebound surface or net 24 to receive and reflect an object such as a ball. A user can be positioned on the base 26 in which the object 12 can be projected downward toward the rebound device 10 in which the rebound surface or net 24 reflects the object 12 back to the user with a substantially vertical trajectory toward the user. The rebound device 10 receives the object from a substantially vertical trajectory (downward) and reflects the object 12 to a substantially vertical trajectory (upward) in comparison to the ground level. The rebound device 10 can further be oriented around a user positioned on the base 26 such that a degree of a circle is covered. For instance, a user positioned on the base 26 in FIG. 3, will have the rebound device 10 cover 180 degrees of a circle (e.g., half a circle). In other words, the frame 14 can surround a user positioned on the base 26 (e.g., in approximately a center of the rebound device 10) such that the frame 14 is around the user in at number of degrees of a circle. For instance, the frame 14 can surround a user with 180 degrees, 270 degrees, 360 degrees, among others.

The support members or frame 14 and/or rebound surface 24 (or net) of the device 10 can be manufactured from a heavy duty and durable material, including, but not limited to, plastic, metal, metal alloy, or composite materials. For example, carbon fiber, aluminum, heavy duty fabrics and leather, or any other suitable material sufficient in strength to support the device 10 in use may be used. According to certain embodiments, the support members or frame 14 and/or rebound surface 24 (or net) of the device 10 can be manufactured from a heavy duty molded plastic material. According to another embodiment, the support members or frame 14 and/or rebound surface 24 (or net) of the device 10 are manufactured from a lightweight material.

Figure 6:
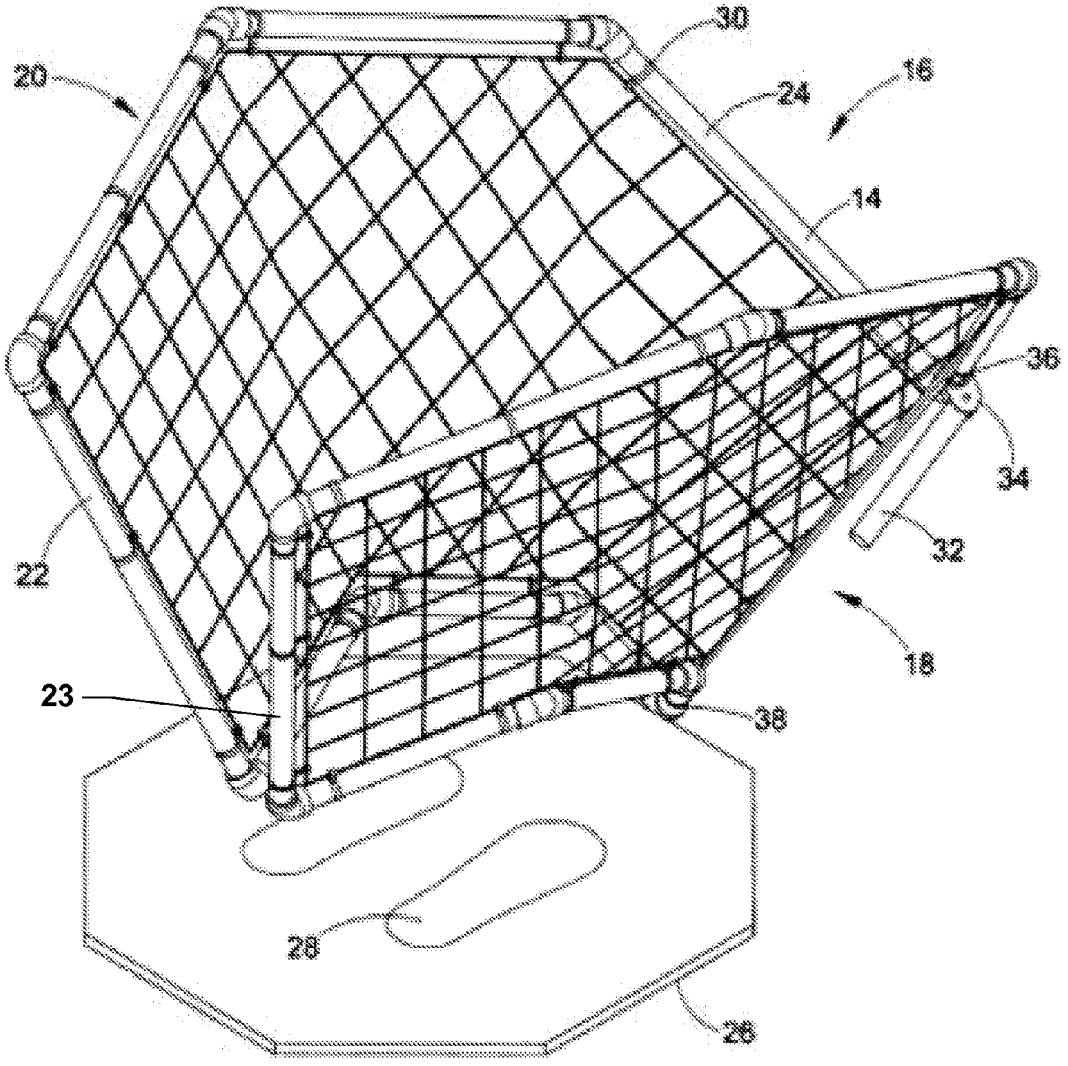
FIG. 6 is a perspective view of an illustrative embodiment of the rebound device in a folded position.
Figure 7:
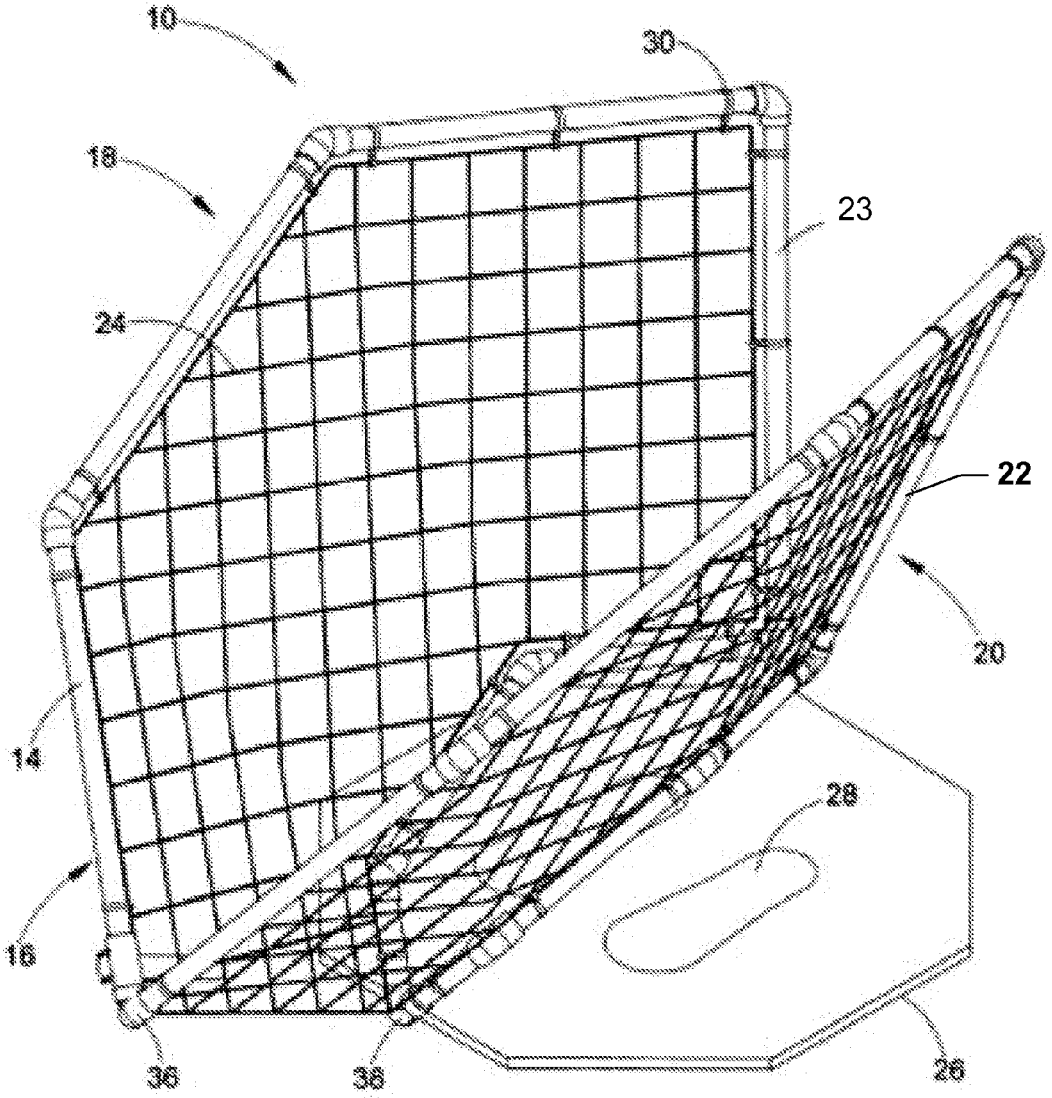
FIG. 7 is a perspective view of an illustrative embodiment of the rebound device in a folded position.
Figure 13:
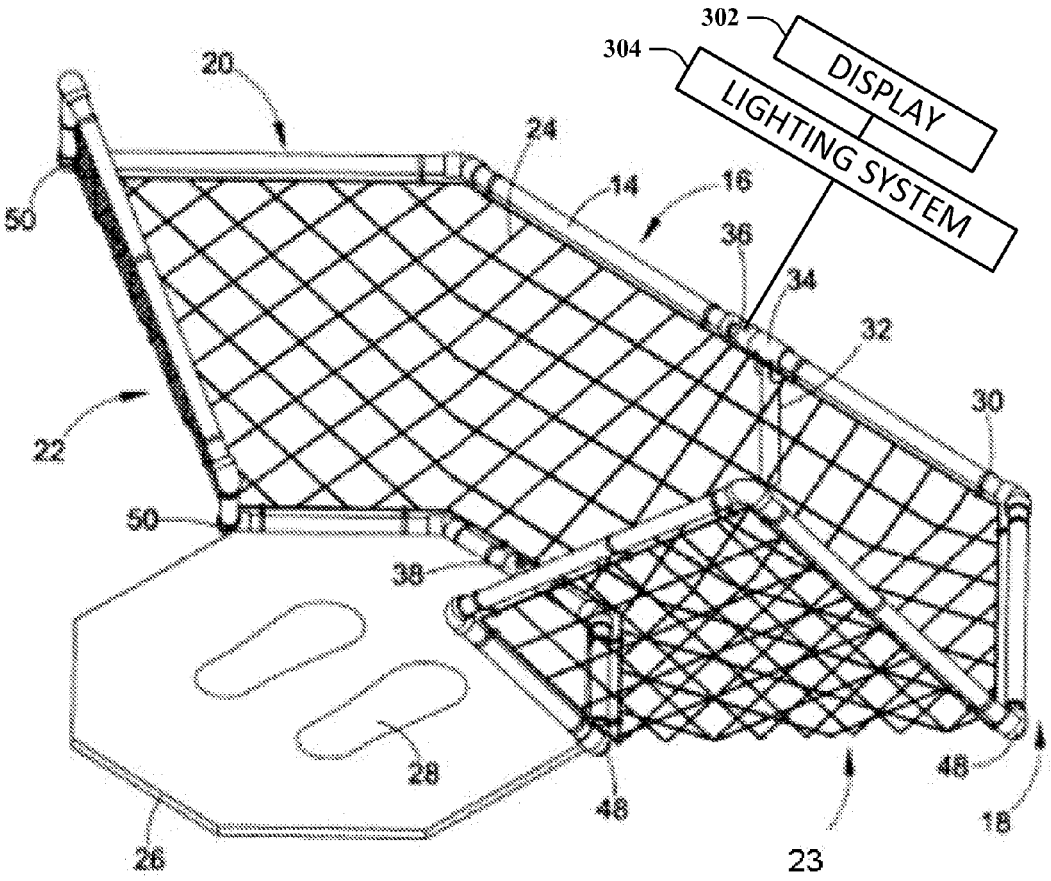
FIG. 13 is a perspective view of an illustrative embodiment of the rebound device.

FIG. 6 and FIG. 7 illustrate opposing perspective views of the rebound device 10 in a folded position through the hinge 36 located on the front side portion 16 and the hinge 38 located on the inner portion of the frame 14 (e.g., portion of the frame closest in distance to the base 26) of the rebound device 10. FIG. 6 and FIG. 7 also illustrate the leg 32 in a folded up position (e.g., kickstand-like configuration). The device 10 can be folded in any suitable manner and the folded position in FIG. 6 and FIG. 7 is not to be limiting on the subject innovation. For example, the hinges 36 and 38 can be included with additional hinges at other locations on the frame 14. For instance, the device 10 can be folded such that each section of a semi-octagon can be folded onto one-another. In another example, the device 10 may not include hinges. In another example, the device 10 can include hinges 36 and 38 along with hinges (not shown) to enable folding as illustrated in FIG. 13.

Figure 8:
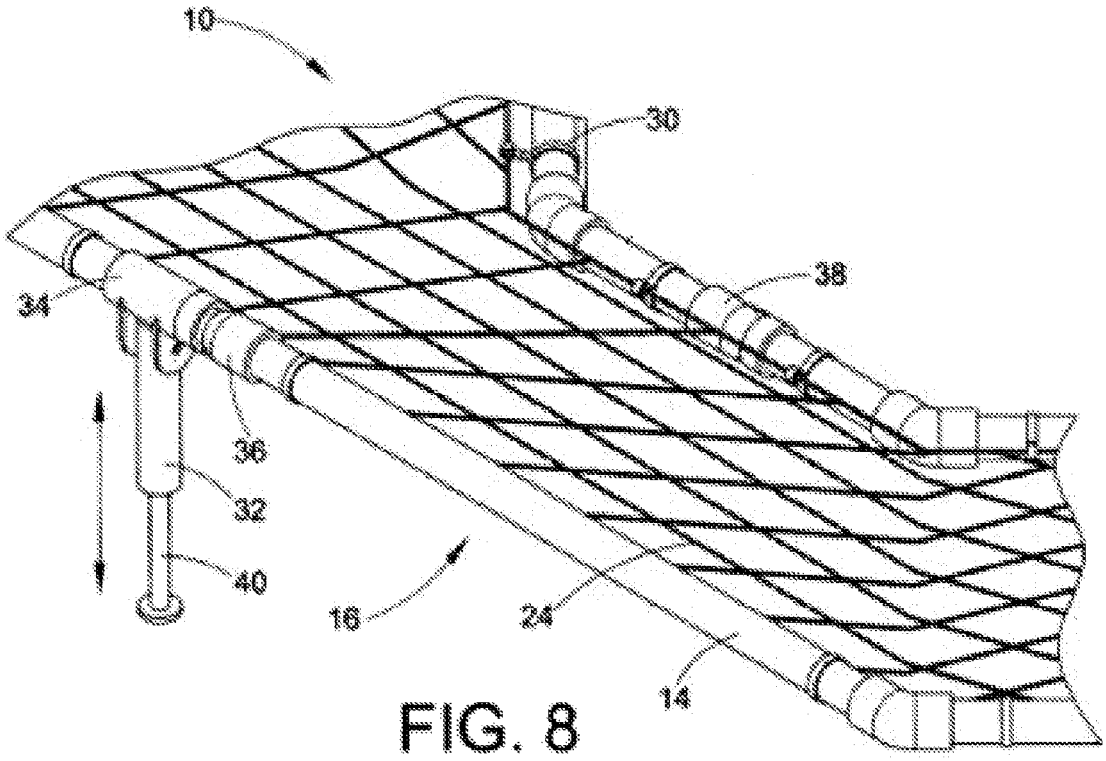
FIG. 8 is a perspective view of a focal point of an illustrative embodiment of the rebound device.

FIG. 8 illustrates a perspective view of a focal point of the front side portion 16 of the rebound device 10. As illustrated in FIG. 8, the leg 32 includes an extendable member 40 which is capable of adjusting the height of the rebound device 10 above the ground (e.g., above a surface that supports the device 10). The leg 32 is attached to the hinge 34 which allows the leg 32 to function as a kickstand. The extendable member 40 can further include a pad to contact the ground in a secure manner. The pad can include a bottom with a texture, wherein the texture can facilitate gripping the surface. The leg 32 (and, in turn, the extendable member 40) can rotate about a portion of the frame 14 360 degrees. Thus, the leg 32 can be folded up and underneath the rebound surface or net 24 or up and on-top of the rebound surface or net 24.

Figure 9:
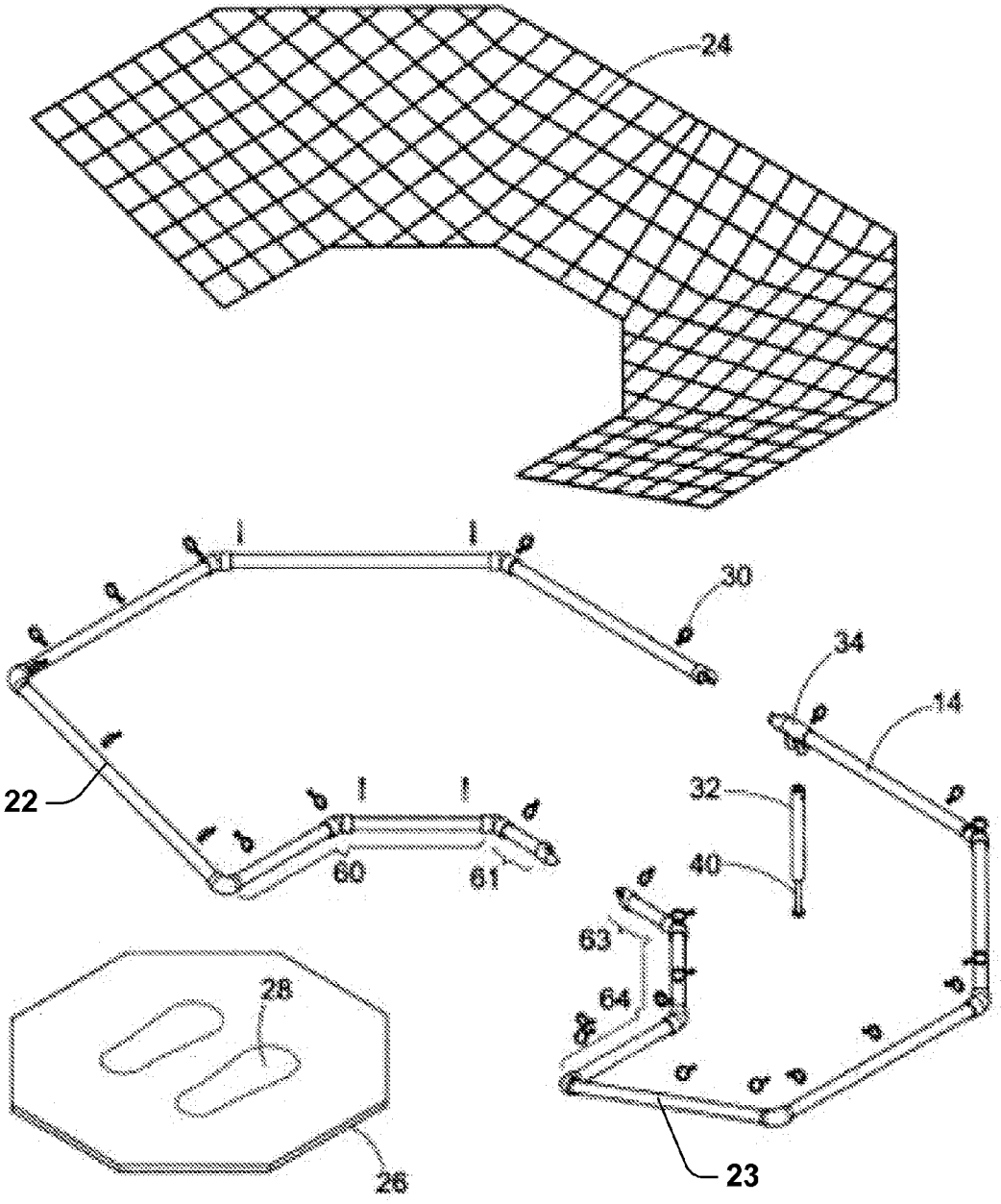
FIG. 9 is an exploded view of an illustrative embodiment of the rebound device.

FIG. 9 illustrates an exploded view of the rebound device 10 that can include the frame 14, rebound surface or net 24, base 26, at least one leg 32, extendable member 40, and/or fastener means or hooks 30. The support members or frame 14, as discussed, can be shaped in a polygonal fashion as shown by a first element 60 (that comprises a first and second side of an semi-octagon), a second element 61 and third element 63 (that comprises a third side of an semi-octagon, also referred to as the second element 62), and a fourth element 64 (that comprises a fourth and fifth side of an semi-octagon). It is to be appreciated that the exploded view in FIG. 9 can be a kit for the rebound device 10. The kit for the rebound device 10 can be utilized to construct the rebound device 10. Moreover, it is to be appreciated that there can be any suitable number of leg(s) 32 and a single leg 32 is illustrated for the sake of brevity. Thus, one or more legs 32 (and, in turn, one or more extendable members 40) can be employed (See FIG. 11A and FIG. 11B). Additionally, it is to appreciated that a number of fastener means or hooks 30 can be employed to secure the rebound surface or net 24 to the frame 14. For instance, more or less faster means or hooks 30 can be utilized than the number illustrated in FIG. 9. Additionally, the means for securing the rebound surface or net 24 to the support members or frame 14 of the device 10 can include, for example, buckles, snaps, clips, and VELCRO hook and loop fasteners, and the like.

Figure 10:
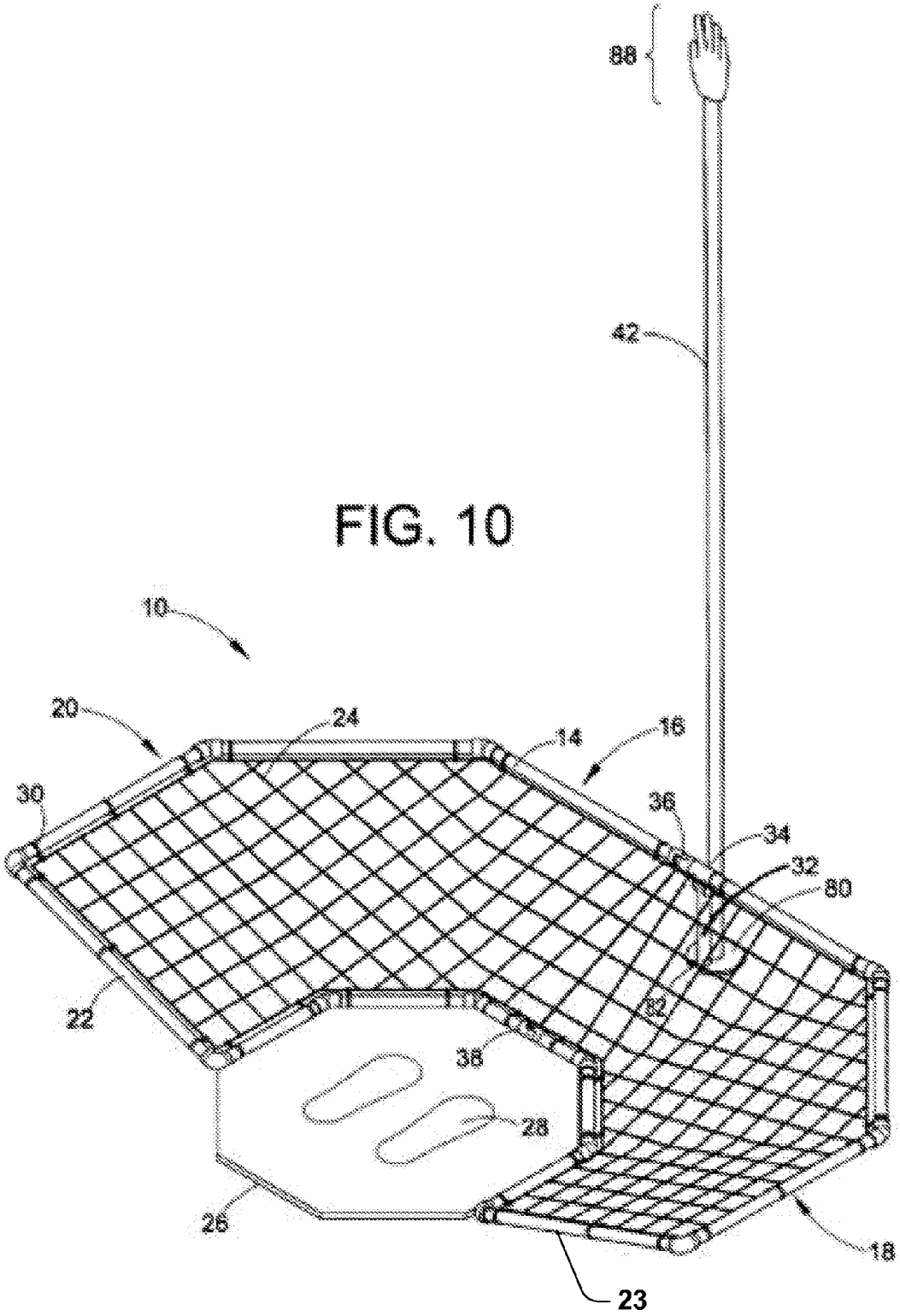
FIG. 10 is a perspective view of an illustrative embodiment of the rebound device.

FIG. 10 illustrates a perspective view of an exemplary rebound device 10 which includes an obstruction 88 such as an extended hand (as depicted) attached to a pole or mast 42 on the front side portion 16 of the rebound device 10. The obstruction 88 can simulate a defender in a sport (e.g., a defender attempting to block a ball carrier in a game situation, among others). For instance, the obstruction 88 can be attached to the mast 42 that is attached to a portion of the frame, wherein the obstruction 88 can impede at least one of a sight path of the user or a path of the object 12 or ball during the substantially vertical downward trajectory and the substantially vertical upward trajectory. In another example, the obstruction 88 can be utilized with a lighting system (discussed in more detail below in FIG. 13), wherein the obstruction 88 can be incorporated into a game or point system. Thus, the obstruction 88 can move from a first position to a second position, wherein the obstruction 88 can impede at least one of a sight path of the user or a path of the object during the substantially vertical downward trajectory and the substantially vertical upward trajectory. A means for securing the obstruction 88 and/or the pole or mast 42 to the device 10 can include a slot and groove assembly 82, wherein a bottom surface of the leg member 32 (e.g., the pad, among others) slideably engages a corresponding groove disposed along a bottom surface (base) 80 of the obstruction 88. It is to be appreciated that the obstruction 88 attached to the pole or mast 42 can be located on the front side portion 16 (as depicted), the left side portion 20, the right side portion 18, the back side portion of the left side portion 22, the back side portion of the right side portion 23 or a suitable combination thereof. For instance, more than one obstruction 88 attached to the pole or mast 42 can be utilized in one or more portions of the rebound device 10. In other words, a user can emphasize one or more areas to simulate real game action by placing at least one obstruction 88 on at least one pole 42 with the rebound device 10.

Figure 11A:
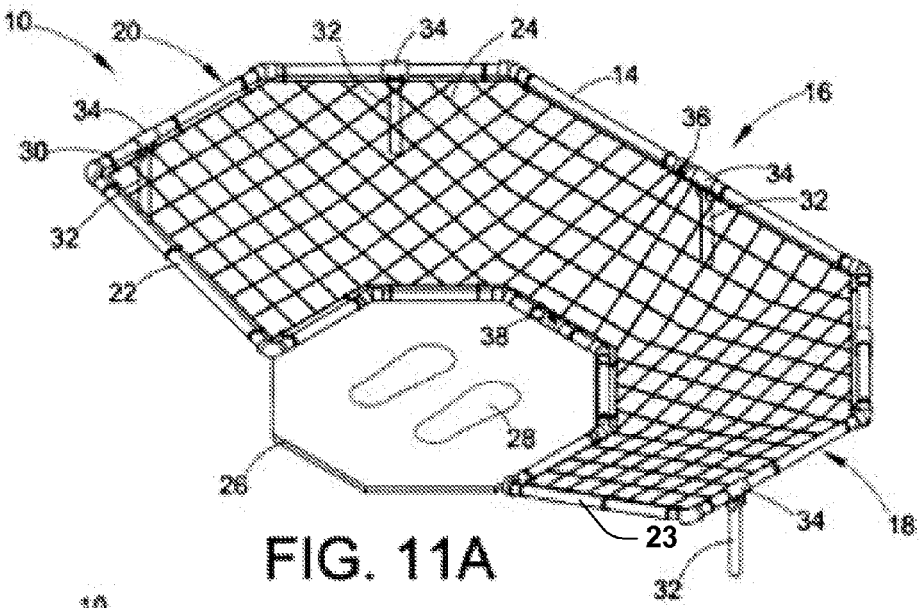
FIG. 11A is a perspective view of an illustrative embodiment of the rebound device.
Figure 11B:
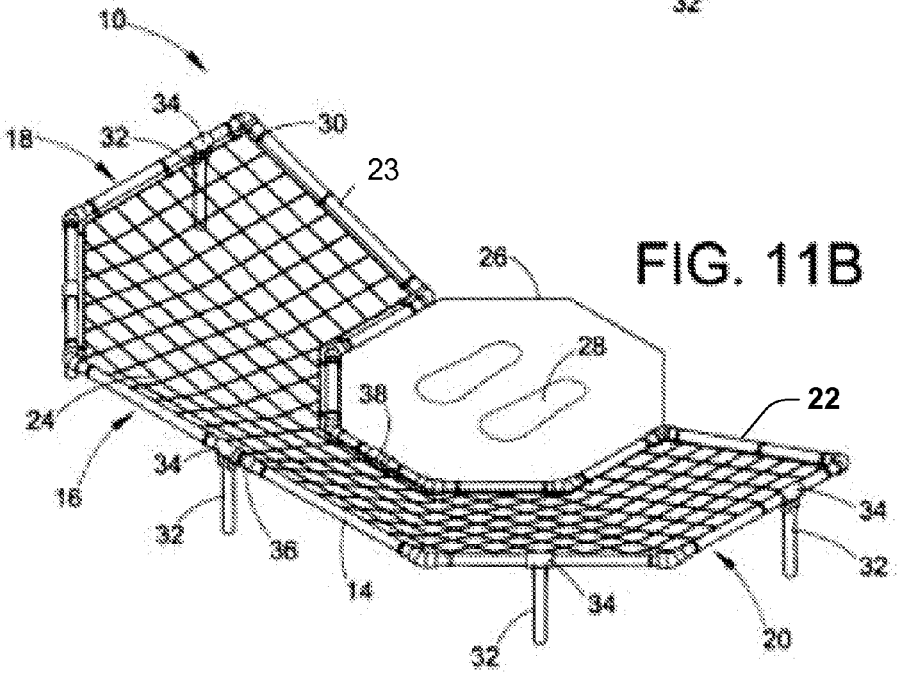
FIG. 11B is a perspective view of an illustrative embodiment of the rebound device.

FIG. 11A and FIG. 11B illustrate opposing perspective views of a rebound device 10 having multiple legs 32 around the frame 14. It is to be appreciated that there can a number of legs 32 (and, in turn extendable members 40) in various locations on the frame 14. For instance, the legs 32 can be on the outer portion of the frame 14 (e.g., portion of frame furthest distance from the user). In another example, the inner portion of the frame 14 can be secured to the ground to increase stability. For instance, the inner portion of the frame 14 can be secured to the ground or ground surface by a spike, an anchor, a rope, among others.

Figure 12:
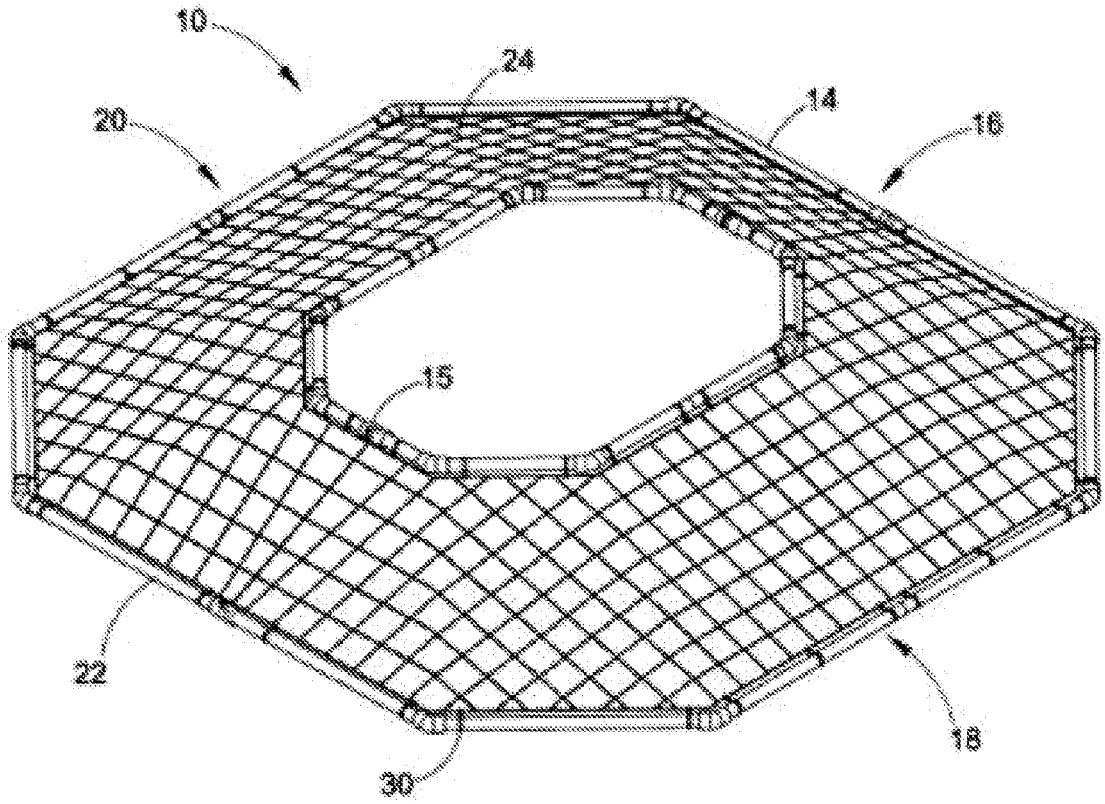
FIG. 12 is a perspective view of an illustrative embodiment of the rebound device.

FIG. 12 illustrates an exemplary embodiment of the rebound device 10. The rebound device 10 can surround a user completely (e.g., 360 degrees) which would enclose the user and the base (not shown) where the user is positioned. In such a configuration, the outer portion (e.g., also referred to as outer frame) of the frame 14 can completely surround the user without the back side portion 22 of the left side portion 20 and/or the back side portion 23 of the right side portion 18. Moreover, the configuration can include an inner frame 15 (e.g., comparable to the inner portion of the frame 14 as described above). The inner frame 15 and the outer portion of the frame 14 can be connected by the rebound surface or net 24. Moreover, the rebound device 10 can be oriented such that the inner frame 14 is above the ground level and the outer portion of the frame 14 is on the ground level plane (as depicted in FIG. 12) or, in the alternative, the inner frame 14 can be on the ground level and the outer portion of the frame 14 is above the ground level. It is to be appreciated that the rebound device 10 can include supporting members (not shown) interconnecting the inner frame 15 with the outer portion of the frame 14 in order to provide structural support. Moreover, such supporting members (not shown) can be oriented such to provide a target for the rebound device 10 to receive an object or ball. For instance, the rebound device 10 in FIG. 12 can include supporting members (not shown) connecting rounded corners of the inner frame 15 with the rounded corners of the outer portion of the frame 14 to create a sectioned octagon.

FIG. 13 illustrates an exemplary embodiment of the rebound device 10 wherein the right side portion 18 and the back side portion 23 of the right side portion 18 of the rebound device 10 is foldable in an upright position via two hinges 48 and the left side portion 20 of the back side portion 22 of the left side portion 20 of the rebound device 10 is foldable in an upright position via two hinges 50. As discussed, the rebound device 10 can include hinges (similar to the hinges 36, 38, 48, 50) at various locations on the frame 14 in order to provide a foldable rebound device 10.

For instance, many sports and physical activities involve the use of bounce passes where participants or athletes pass or throw a ball or object towards each other by first bouncing the ball on the ground. An example of a sport which commonly involves the use of bounce passes is, but not limited to, basketball. Basketball is a sport that is used solely as an example and is not to limit the rebound device 10 and/or the object 12. For instance, the rebound device 10 can be utilized with any activity with an object or ball such as, but not limited to, basketball, handball, playing catch, baseball, volleyball, racquetball, tennis, football, soccer, lacrosse, and the like. The device 10 allows individuals and athletes to practice throwing and catching bounce passes by themselves without the need for a second individual to participate in the activity. Non-limiting examples of basketball passing fundamentals and techniques that can utilized with the rebound device 10 include the following:

Two-Handed Chest Pass—one of the most effective and efficient passes that can be used from anywhere on the basketball court. The pass is made by bringing the ball to the chest with both hands on the ball and pushing outward;

Two-Handed Bounce Pass—this type of pass is made similar to the two-handed chest pass but will be directed toward the ground to bounce to the intended recipient. This type of pass is good on the fast break, to a teammate in the post (e.g., under or near the basket), under a defender, to a teammate making a back-door cut, on out-of-bounds plays, etc. Many times, players will make a shot or high-pass fake before making the bounce pass—the bounce pass is one of the slowest passes available;

Two-Handed Overhead Pass—an effective basketball passing option for every player on the court. Players often use it to start a fast break, forwards will use it to hit post players or guards cutting off the post, guards use it to hit the post, centers and players receiving high passes use it to make a quick return pass or pass off. This type of pass is easy to control and helps you keep the ball away from your defender. The pass is made by holding the ball with two hands and throwing the ball with a motion that starts behind the head (similar to a soccer throw-in);

Push Pass—used most often to advance the ball down the floor in order to set up the offense or to get the ball through or past a close-guarding defender (usually to a cutter). The bounce pass version is good for passes to a cutter on fast breaks or reverses, many out-of-bounds plays, to a post player or to pass under a defender;

Off-the-Dribble Pass—one of the quickest basketball passing options because there is essentially no set-up involved with it. As a player is dribbling, instead of bouncing the ball back to the floor for another dribble, the players moves their hand behind the ball and pushes it towards a teammate as a pass. It is difficult for defenders to steal this pass because they are expecting a dribble instead of the pass;

Baseball Pass—effective for long passes to a cutter or to inbound the ball quickly after allowing a score. The ball is placed high above the side of the player's head with the passing hand behind the ball while the other hand is in front of and slightly under the ball; and Behind-the-Back Pass—this pass can be used off the dribble, standing still or while moving toward the basket and is used often with two-on-one fast breaks. If the player can deliver this pass correctly, it will be very difficult for opponents to defend.

The device 10 can be used to practice for any sport or activity that involves the use of bounce passes or the use of throwing, hitting, kicking or otherwise projecting a ball in a downward motion towards the ground onto the rebound device 10 (allowing the ball to bounce or reflect off the rebound device 10 in a substantially vertical (upward) manner). The rebound device 10 is placed relatively low (in regards to height) off the ground and provides numerous angles without requiring the pitch of the device 10 to be adjusted (e.g., each region can provide a different angle of reflection for the ball). In addition, the design and functionality of the device 10 allows the user to receive balls and multiple other types of projectiles at varying speeds.

In other embodiments, the rebound surface or net 24 comprises and/or defines at least one target area for aiming the object 12 (e.g., a ball, among others) to be propelled onto the device 10, wherein the ball has a substantially negative vertical trajectory toward the rebound device 10 and a substantially positive vertical trajectory away from the device 10 after being reflected or bounced.

The typical user of the rebound device 10 can be an athlete who wishes to improve his or her passing and catching skills. The rebound device 10 can be used by players of sports which rely on catching, throwing, passing, hitting, kicking, or striking a ball with any part of the body or separate object such as a stick or bat. The rebound device 10 may be used by players of baseball, basketball, lacrosse, handball, racquetball, soccer, tennis or any other sport, individuals of any age for amusement or enjoyment, individuals with physical disabilities (including individuals seated in wheel chairs) and as part of an occupational, physical, or geriatric therapy program. The rebound device 10 may also be in the form of a game where points are tallied allowing individuals using the device to compete with each other or amongst themselves.

In certain embodiments, the rebound device 10 can be designed for use by basketball players so that they may work on improving their bounce passing and catching skills. With the rebound device 10, a basketball player can practice proper technique for passing and catching bounce passes which are tossed back at different angles to the player from the device 10. Players use the rebound device 10 by standing in an opening (e.g., on the base 26) and projecting the ball by any means such as throwing or passing the ball toward (e.g., with a substantially downward trajectory) the device 10. Projections of the ball may be made on any side of the player causing the ball to bounce back from various directions. Thus, the toss back of the basketball to the player simulates the angles at which a basketball player would expect to catch a pass from varying locations on the court (i.e. wing, high post and elbow). The rebound device 10 accomplishes this through its positioning which is relatively low (in regards to height) to the ground. The rebound device 10 is situated about a ground-level plane and reflects a ball back in a motion that is substantially vertical. The rebound device 10 is also designed for multiple angle catching and shooting without needing to turn, resituate or reposition the device 10.

The device 10 can mimic game time situations for basketball players because the reaction and positioning of the body, including, but not limited to, foot placement (position of feet with respect to shoulders and hips, whether feet are parallel and positioned straight ahead pointing to basket, or the shooting foot is slightly ahead of other foot in stance and both feet are pointing to basket, or the shooting foot is slightly ahead of other foot and pointing to basket, while opposite foot is slightly "opened"), in preparation for a shot, which varies depending on the angle at which the ball is caught. Basketball players may use the device 10 to work on all aspects of catching and shooting including layups, stationary shots, shots off the cut, etc. The rebound device 10 is designed for indoor or outdoor use, is compact, portable and can be easily be condensed or disassembled to store in areas of limited space.

Because the device 10 is capable of being placed relatively low to the ground and allows the user to receive rebounded objects at varying angles and slower speeds, the device 10 is safe for use by children and special needs population. The rebound device 10 may also be used by individuals of any age who may not be involved in any particular sport, but who desire to participate in this type of activity to maintain their physical fitness and activity level. For example, the rebound device 10 may be used by children of any age or by individuals with special needs, including, but are not limited to Autistic Disorder, Attention Deficit/Hyperactivity Disorder (AD/HD), Cerebral Palsy, Deafness/Hearing Loss, Down Syndrome, Emotional Disturbance, Epilepsy, Learning Disabilities, Mental Retardation, Pervasive Developmental Disorder (PDD), Reading and Learning Disabilities, Spina Bifida, Traumatic Brain Injury, Visual Impairments, to teach basic bouncing, passing, throwing, catching and other motor and reflex skills.

The rebound device 10 may also be used as a type of rehabilitative or geriatric treatment allowing individuals recovering from injuries, seeking physical therapy, and the elderly an opportunity to remain physically active and maintain motor and reflex skills. The rebound device 10 may also be used as a type of physical or occupational therapy allowing individuals to relearn basic body movements in addition to basic motor and reflex skills. Alternatively, the rebound device 10 may be used by individuals as a game for amusement or enjoyment.

As discussed, the rebound device 10 can be receive a ball projected downwards by a user and projecting the same ball back to the user, wherein the rebound device 10 can include a rebound surface positioned and angled to receive downward projections of the ball from any side of the user. The user typically projects the ball towards the device 10 by throwing or passing the ball in a downward motion towards the rebound device 10 which is positioned on the ground or surface which has a height that is relatively close to the ground. Other methods of projecting the ball towards the device include kicking, shooting, striking or hitting the ball with an object such as a stick or bat, head butting, striking the ball with any other part of the body and any other means of projecting a ball.

In other embodiments, the shape of the device 10 may be square, rectangular, polygonal, octagonal, semicircular, cage-like, or circular. In another embodiment, the ball or object 12 utilized with the rebound device 10 is spherical. The ball utilized with the rebound device 10 may be of any size or shape.

In certain embodiments, the rebound surface or net 24 of the rebound device 10 may comprise a hard surface or a flexible, resilient, elastic surface. In certain embodiments, the rebound surface or net 24 of the rebound device 10 is positioned onto the frame 14. The frame 14 may be of any shape, size, or configuration which is capable of allowing the rebound surface or net 24 to return the ball back to the user. In certain embodiments, the frame 14 comprises several tubular shaped portions which are attached together. It is to be appreciated that the tubular shaped portions (e.g., also referred to as tubular element(s)) can be constructed from a material such as, but not limited to, steel, metal, aluminum, plastic, composite material, PVC, among others. In an embodiment, the tubular element(s) can have a diameter in a range of a range of 0.5 inches to 3 inches. According to certain embodiments, the tubular elements may be attached to one another by rivets, screws, tacks, buckles, snaps, clips, fasteners and the like.

In certain embodiments, the rebound surface or net 24 can include an elastic and flexible surface such as an elastic fabric. In embodiments where an elastic fabric is utilized, the elastic fabric may be attached to the frame by any type of fastening means. Examples of ways to fasten the elastic fabric to the frame 14 include use of a buckle, a button, a carabineer or snap ring, a clasp, a clip, a cotter, a grommet or eyelet, a dowel, a hook, a knot, a lashing, a pin or any other means known to those of skill in the art. In another embodiment, the rebound surface or net 24 can be a surface or netting with a spring to provide elasticity.

A tensioner (not shown) may also be included in conjunction with or separate from the fastening means to adjust the tension and elasticity of the elastic fabric. Adjusting the tension of the elastic fabric can increase the force of projection of the ball back to the user. In certain embodiments, the device 10 may comprise a means for providing adjustment of the tautness or tension of the rebound surface or net 24, wherein the adjustment-providing means includes headed fasteners which are disposed at selected locations around the perimeter of the frame wherein each fastener has a head and a shank which extends through a side, top or bottom member of the arrangement and the corresponding rigid structural member disposed adjacent to the side, top or bottom member of the arrangement, and a group of nuts wherein each nut is threadably secured upon the shank of a corresponding headed fastener so that the side, top or bottom member of the arrangement and the corresponding rigid structural member are captured between a nut and a head of a fastener and so that by tightening or loosening the nut about the shanks, the tautness of the rebound surface or net 24 can be adjusted.

In certain embodiments, the elastic fabric comprises at least one netting. In certain embodiments, the netting may be a continuous single piece. In other embodiments at least two separate nettings may be used. The netting may be attached to the frame by fastener means or hooks 30. Examples of fastener means 30 which may be used to attach the netting to the frame 14 of the rebound device 10 include those described above.

In certain embodiments, the elastic fabric or elastomeric sheet is comprised of a lightweight and rigid material, aluminum, plastic, polyvinyl chloride, neoprene, nitrile, ethylene propylene diene monomer (EPDM), hypalon, styrene-butadiene rubber (SBR), urethane, latex, silicone and/or Viton®.

In certain embodiments, the rebound device 10 comprises at least one leg 32 attached to a bottom portion of the frame 14 allowing the frame 14 and rebound surface or net 14 to be elevated relative to a ground position. According to certain embodiments, the leg 32 may be attached to the support members or frame 14 by rivets, screws, tacks, buckles, snaps, clips, fasteners and the like. In general, the frame 14 and the rebound surface or net 24 can include the left side portion 20, the front side portion 16, the right side portion 18, the back side portion 22 of the left side portion 20 and the back side portion 23 of the right side portion 18. In certain embodiments, the frame 14 and the rebound surface or net 24 can completely surround a use positioned on the base 26.

In certain embodiments, at least one leg 32 is attached to the bottom portion of the left side portion 20 of the frame 14, at least one leg 32 is attached to the bottom portion of the front side portion 16 of the frame 14, at least one leg 32 is attached to the bottom portion of the right side portion 18 of the frame 18, at least one leg 32 is attached to the bottom portion of the back side portion of the left side portion 22, and at least one leg 32 is attached to the bottom portion of the back side portion of the right side 23. In one particular embodiment, the frame 14 and the rebound surface or net 24 of the rebound device 10 include the left side portion 20, the front side portion 16 and the right side portion 18 wherein the left side portion 20 of the frame 14 comprises two legs 32, the front side portion 16 of the frame 14 comprises at least one leg 32 and the right side portion 18 of the frame 14 comprises two legs 32.

The legs 32 may be detachable from the frame 14 allowing the user to adjust the height of the rebound device 10 or easily carry and store the rebound device 10 in an area of limited space. The legs 32 attached to the rebound device 10 may also be capable of being adjusted to any position relative to the frame 14. In certain embodiments, the legs 32 can be adjusted ranging from 0° to 180° in a uniplanar direction perpendicular to the frame 14. An example of a mechanical means which would allow for such a range of movement is a kickstand which can be pivoted to any position desired. In certain embodiments, a mechanical lock may be used to lock the leg 32 at a particular angle relative to the frame 14. Legs 32 may also be attached to the frame 14 through a ball and socket joint, allowing the legs 32 to be moved in a circular motion relative to the frame 14. A mechanical lock may be used in conjunction with the ball and socket joint to lock the legs 32 in a specific position relative to the frame 14.

In certain embodiments, the rebound device 10 may comprise a lighting system 302 (illustrated in FIG. 13) capable of lighting the left side portion 20, front side portion 16, right side portion 18, and/or subsections thereof, and/or a combination thereof to indicate to the user that a downward throw of an object is to be made to a certain side portion of the rebound device 10. This embodiment of the rebound device 10 may be used improve the users quickness, decision making process and reflexes. This embodiment may be used where the rebound device 10 is designed for use by basketball players in order to simulate real game time pressures and situations allowing the user to prepare for these moments. The lighting system 302 may be also used as a game where the user can accumulate points by hitting the lit target within the rebound device 10. Scores may be tallied on an analog or digital scoreboard (also referred to as display 304 illustrated in FIG. 13) connected to the rebound device 10.

The rebound device 10 may comprise at least two subportions of frame and netting. In certain embodiments, the frame 14 and rebound surface or net 24 comprise the left side portion 20 and the right side portion 18. In other embodiments, the frame 14 and rebound surface or net 24 comprise the left side 20 portion, the front side portion 16 and the right side portion 18. In other embodiments, the frame and netting comprises the left side portion 20, the front side portion 16, the right side portion 18, the back side portion 22 of the left side portion 20, and the back side portion 23 of the right side portion 18. The sub-portions of the frame 14 and rebound surface or net 24 may be designed to be assembled and detached as desired allowing the user to an open space to practice other skills when using the device 10 and allowing the user to easily carry and store the device 10 in limited spaces. For basketball related uses, the open space can be used by participants to dribble, pass or shoot the basketball among other uses.

The frame 14 and rebound surface or net 24 of the different side portions of the rebound device 10 comprise an outer portion of the frame 14 towards the area outside the device 10 and an inner portion of the frame 14 towards the inner area of the device 10. In certain embodiments, the outer portion of the frame 14 of the rebound device 10 is positioned at an angle relative to the ground which results in the outer portion of the frame 14 to be elevated above the ground and positioned at a height greater than that of the inner portion of the frame 14 and rebound surface or net 24. In certain embodiments, the angle of elevation of the outer portion of the frame 14 relative to the ground is approximately between 15 degrees and 60 degrees. In an embodiment, the angle can be 45 degrees. Alternatively, the inner side portion of the frame 14 on the rebound device 10 is positioned at an angle relative to the ground which results in the inner portion of the frame 14 to be elevated above the ground and positioned at a height greater than that of the outer portion of the frame 14. In certain embodiments, the angle of elevation of the inner portion of the frame 14 relative to the ground is approximately between 15 degrees and 60 degrees. In an embodiment, the angle can be 45 degrees.

In certain embodiments, the angle of elevation of the inner portion or the outer side portion of the frame 14 relative to the ground is adjustable. One method of adjusting the inner or outer portion of the frame 14 is by providing legs 32 which are adjustable to different lengths. By increasing or decreasing the lengths of the legs 32, the angle of elevation of the inner portion of the frame 14 or outer portion of the frame 14 can be increased or decreased, thereby increasing or decreasing the height of the inner portion or outer side portion of the frame 14 relative to the ground position.

The height of the legs 32 may be adjusted. In certain embodiments, the legs 32 may be adjusted by folding a lower portion of the leg 32 up 180° to a position adjacent to an upper portion of the leg 32. In other embodiments, the height of the legs 32 may be adjusted by telescoping an upper portion of the leg 32 within a lower portion of the leg 32 or vice versa. By telescoping it is meant that a part of the leg 32 is capable of being slid out from within another part of the leg 32 or slid into another part of the leg 32 causing the length of the leg 32 to increase or decrease respectively. In certain embodiments, the adjustment means used for adjusting the height of the legs 32 may also include a locking means such as a pin to secure the adjustment of the height of the legs 32 in place.

In other embodiments, a pitch of the device 10 may be altered by adjusting the height of the legs 32. In another embodiment, the rebound device 10 may be placed relatively low to the ground and provides numerous angles without requiring a pitch of the device 10 to be adjusted. The frame 14 and/or the rebound surface 24 may comprise a single molded piece, or may comprise separate pieces that are connected to one another.

The rebound device 10 may be designed so that at least two sub-portions of the rebound device 10 are adjustable to different heights relative to the ground position. For example, in certain embodiments, the right side portion 18 of the rebound device 10 may be adjusted to a height greater than that of the left side portion 20 and vice versa, the front side portion 16 may be adjusted to a height that is greater than at least one back side portion (e.g., back side portion 22, back side portion 23) or vice versa, or a plane on the rebound surface or net 24 can be a first height or angle and another plane on the rebound surface or net 24 can be a second height or angle. The rebound device 10 may also be designed to adjust the height of the inner and outer portion of the frame 14 in alternative embodiments where a unitary frame 14 and rebound surface or net 24 is provided. Such unitary frames can be provided with a mechanical means such as a hinge to allow the angle of the frame to be adjusted with the adjustment of the length of the legs 32. Alternatively, the frame 14 may comprise several tubular portions which are fitted built in screws allowing the length of the different tubular portions of the frame 14 to be adjusted with the adjustment of the length of the legs 32. In alternative embodiments, the unitary frame may comprise a moldable material allowing the unitary frame to be shaped or adjusted with the adjustment of the height of the legs 32. Therefore, in certain embodiments, the frame 14 and/or at least one leg 32 is adjustable to alter the height and/or angle of the frame 14 and rebound surface or net 24 from the ground position. Such adjustments may be made to tailor the device 10 for use by individuals of all ages, heights and abilities.

In certain embodiments, the left side portion 20, front side portion 16, right side portion 18 and optionally, back side portions 22, 23 of the frame 14 and/or rebound surface 24 are detachable. Detaching the different portions of the rebound device 10 can allow for the device 10 to be easily compacted and carried. Also, where the rebound device 10 is designed for use by basketball players, detaching the different portions of the rebound device 10 can also provide the user with a free path to drive to the lane and take a shot or lay-up or move outside the parameters of the rebound device 10 and take a shot.

In certain embodiments, the length of the circumference forming the left side portion 20, front side portion 16, right side portion 18 and/or back side portions 22, 23 of the frame 14 are adjustable. Adjusting the length of the circumference of the left side portion 20, front side portion 16, right side portion 18 and optionally, back side portions 22, 23 of the frame 14 may be accomplished through any means, such as a butterfly fold. A butterfly fold may be accomplished through telescoping of different portions of the frame 14. Where the rebound device 10 is designed for use by basketball players, reducing the length of the circumference forming the left side portion 20, front side portion 16, right side portion 18 and optionally, back side portions 22, 23 of the frame 14 can provide a larger area or free path where the user can, after catching the bounce pass from the device 10, leave the area within the device 10 to do another activity. For example, in basketball, the user may need to drive to the lane after catching a bounce pass from the device 10 or may need to move outside the boundaries of the rebound device 10 and take a shot. Another use for adjusting the length of the circumference of the device 10 is to allow the device 10 to be compacted for ease of carrying and storage when not in use.

In certain embodiments, at least one left side portion 20, at least one front side portion 16 and at least one right side portion 18 of the frame 14 and/or rebound surface or net 24 of the rebound device 10 are foldable. Folding the different portions of the device 10 together may be desirable to reduce the area of netting desired for use. For example, where the rebound device 10 is designed for use by basketball players, folding a certain portion of the device 10 can provide a larger area or free path where the user can, after catching the bounce pass from the device 10, leave the area within the device 10 to do another activity. For example, in basketball, the user may need to drive to the lane after catching a bounce pass from the device or may need to move outside the boundaries of the rebound device 10 and take a shot. Another use for folding the different portions of the device 10 together is to allow the device 10 to be compacted for ease of carrying and storage when not in use.

In certain embodiments, the rebound device 10 comprises the obstruction 88 which is designed to block the user from having a free path to project the ball or object 12 to another person or towards a goal after catching a pass received from the rebound device 10. The means for securing the obstruction 88 to the device 10 may include, for example, buckles, snaps, clips, and VELCRO hook and loop fasteners, and the like. According to a further embodiment, the means for securing the obstruction 88 to the device 10 may include a slot and groove assembly wherein the bottom surface of the leg member slideably (e.g., leg 32) engages a corresponding groove disposed along the bottom surface (base) of the obstruction 88.

Where the rebound device 10 is designed for use by basketball players, the obstruction 88 may comprise a hand or silhouette of another player blocking the user from making a pass or shooting the ball towards the basketball hoop, thereby allowing the player to learn how to shoot over or pass around a defender. In certain embodiments, the obstruction 88 is capable of automatically moving between the left side portion 20, front portion 16, right side portion 18 and/or the back side portions 22, 23 of the device 10. The obstruction 88 may also be capable of moving towards and away from the user, mimicking the movements of a defender on a basketball court. The user would then have to decide whether to make a bounce pass to a side portion of the device 10 where the obstruction 88 is not present, shoot the ball, drive the ball to the lane, or physically pass the ball to another participant who is not using the device 10. According to other embodiments, the rebound device 10 is constructed of replaceable parts in order to prolong the lifetime of the device at a nominal cost.

It will be understood that the embodiment(s) described herein is/are merely exemplary, and that one skilled in the art may make variations and modifications without departing from the spirit and scope of the invention. All such variations and modifications are intended to be included within the scope of the invention as described hereinabove. Further, all embodiments disclosed are not necessarily in the alternative, as various embodiments may be combined to provide the desired result.

What has been described above includes examples of the subject innovation. It is, of course, not possible to describe every conceivable combination of components or methodologies for purposes of describing the claimed subject matter, but one of ordinary skill in the art may recognize that many further combinations and permutations of the subject innovation are possible. Accordingly, the claimed subject matter is intended to embrace all such alterations, modifications, and variations that fall within the spirit and scope of the appended claims.

Specific embodiments of an innovation are disclosed herein. One of ordinary skill in the art will readily recognize that the innovation may have other applications in other environments. In fact, many embodiments and implementations are possible. The following claims are in no way intended to limit the scope of the subject innovation to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but generally known by those of skill in the art.

Although the subject innovation has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (e.g., components, assemblies, devices, compositions, garments, materials, etc.), the terms (including a reference to a "means") used to describe such elements are intended to correspond, unless otherwise indicated, to any element which performs the specified function of the described element (e.g., that is functionally equivalent), even though not structurally equivalent to the disclosed structure which performs the function in the herein illustrated exemplary embodiment or embodiments of the innovation. In addition, while a particular feature of the innovation may have been described above with respect to only one or more of several illustrated embodiments, such feature may be combined with one or more other features of the other embodiments, as may be desired and advantageous for any given or particular application. Although certain embodiments have been shown and described, it is understood that equivalents and modifications falling within the scope of the appended claims will occur to others who are skilled in the art upon the reading and understanding of this specification.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

What is claimed is:

1. A rebound device, comprising:

a frame that includes at least one tubular element, the frame includes an inner portion that defines an area approximate to a ground level, the inner portion is a semi-polygonal shape wherein the semi-polygonal shape covers a range of degrees of a circle about an approximate center of the semi-polygonal shape, the range of degrees is less than 360 degrees, and an outer portion above the ground level that corresponds in shape to the inner portion, the outer portion of the frame is connected to the inner portion of the frame by at least one back side portion;

a rebound surface engaged to the frame and in-between the inner portion of the frame, the outer portion of the frame, and the at least one back side portion; and the rebound surface extends upwardly and outwardly in a plurality of planes to create a plurality of rebound regions that receive an object from a substantially vertical downward trajectory and reflect the object to a substantially vertical upward trajectory to a user.

2. The rebound device of claim 1, the range of degrees is greater than approximately 180 degrees.

3. The rebound device of claim 1, further comprising at least one leg attached and extending downwardly from the outer portion of the frame to engage at least one of the ground level or the ground level and the inner portion of the frame, wherein the at least one leg raises the outer portion of the frame above the ground level.

4. The rebound device of claim 1, further comprising a means for attaching the rebound surface to the frame.

5. The rebound device of claim 1, the at least one tubular element is approximately between 0.5 inch and 1.5 inch tubing that is shaped like a square.

6. The rebound device of claim 1, the rebound surface is comprised of a solid material.

7. The rebound device of claim 1, the rebound surface is comprised of an elastic material.

8. The rebound device of claim 1, the rebound surface is a net.

9. The rebound device of claim 1, the frame is rigid and the rebound surface is flexible.

10. The rebound device of claim 1, the frame is rigid and the rebound surface is rigid.

11. The rebound device of claim 1, further comprising at least one leg attached and extending downwardly from at least one of the outer portion of the frame or the inner portion of the frame to engage the ground level and to raise at least one of the outer portion of the frame or the inner portion of the frame above the ground level.

12. The rebound device of claim 11, the leg further comprises an extendable member with a length that is adjustable between two or more alternative lengths with telescoping from the leg.

13. The rebound device of claim 1, the frame further comprises at least one hinge on the outer portion of the frame and at least one hinge on the inner portion of the frame, the hinges provide a portion of the frame to fold.

14. The rebound device of claim 1, further comprising a means for increasing a tension of the rebound surface.

15. The rebound device of claim 1, further comprising an anchor that secures at least a portion of the frame to a ground surface on the ground level.

16. The rebound device of claim 1, further comprising an obstruction attached to a pole that is attached to a portion of the frame, the obstruction impedes at least one of a sight path of the user or a path of the object during the substantially vertical downward trajectory and the substantially vertical upward trajectory.

17. The rebound device of claim 1, further comprising a lighting system disposed about the frame that indicates at least one of a target on the rebound surface or one of the plurality of planes on the rebound surface that is to receive the object from the user.

18. The rebound device of claim 17, further comprising:

a digital display that displays a portion of data related to the received object from the user; and an obstruction that moves from a first position to a second position, the obstruction impedes at least one of a sight path of the user or a path of the object during the substantially vertical downward trajectory and the substantially vertical upward trajectory.

19. A rebound device, comprising:

a frame that includes at least one tubular element, the frame includes an inner portion that defines an area approximate to a ground level, the inner portion is a semi-octagonal shape, and an outer portion above the ground level that corresponds in shape to inner portion, the outer portion of the frame is connected to the inner portion of the frame by at least one back side portion;

the frame covers a range of degrees of a circle about an approximate center of the semi-octagonal shape, the range of degrees is less than 360 degrees;

a rebound surface engaged to the frame and in-between the inner portion of the frame, the outer portion of the frame, and the at least one back side portion;

the rebound surface extends upwardly and outwardly to form a plurality of planes, the plurality of planes create a plurality of rebound regions that are configured to receive an object from a substantially vertical downward trajectory and reflect the object to a substantially vertical upward trajectory; and a leg attached to the outer portion of the frame to raise the outer portion above the ground level.

20. A rebound device, comprising:

two frames, each frame includes at least one tubular element and an inner portion and an outer portion, the outer portion of the frame is connected to the inner portion of the frame by at least one back side portion;

the inner portion of each of the two frames defines an area proximate to a ground level, and the outer portion of each of the two frames is above the ground level and corresponds in shape to the inner portion, each of the two frames includes a rebound surface engaged to the inner portion, the outer portion, and the at least one back side portion for each of the two frames;

the two frames cover a range of degrees of a circle about an approximate center in a semi-polygonal shape, the range of degrees is less than 360 degrees; and each rebound surface of each of the two frames extends upwardly and outwardly in at least one plane to create a rebound region that receives an object from a substantially vertical downward trajectory and reflects the object to a substantially vertical upward trajectory.

* * * * *